US008857871B2

(12) United States Patent
Farmer

(10) Patent No.: US 8,857,871 B2
(45) Date of Patent: Oct. 14, 2014

(54) CLAY TARGET MAGAZINE

(76) Inventor: Scott Farmer, Napa, CA (US)

( * ) Notice: Subject to any disclaimer, the term of this patent is extended or adjusted under 35 U.S.C. 154(b) by 222 days.

(21) Appl. No.: 13/066,484

(22) Filed: Apr. 15, 2011

(65) Prior Publication Data

US 2012/0261883 A1 Oct. 18, 2012

(51) Int. Cl.
*A63B 47/02* (2006.01)
*F41J 9/30* (2006.01)

(52) U.S. Cl.
CPC ..... *F41J 9/30* (2013.01)
USPC ..... 294/19.2; 473/517; 221/197; 221/287; 124/46

(58) Field of Classification Search
USPC ..... 124/8, 46, 47, 41.1, 42, 43, 45, 50; 294/19.2, 26.5, 137, 143, 165; 221/176, 197, 151, 152, 154, 287; 273/362, 399, 355, 406; 211/41.2, 49.1
See application file for complete search history.

(56) References Cited

U.S. PATENT DOCUMENTS

| | | | | | |
|---|---|---|---|---|---|
| 2,027,546 | A * | 1/1936 | MacDonald | 294/19.2 |
| 2,760,807 | A * | 8/1956 | Watson | 294/19.2 |
| 3,186,593 | A * | 6/1965 | Miotke | 221/297 |
| 3,206,067 | A * | 9/1965 | Smith, Jr. et al. | 221/281 |
| 5,140,971 | A * | 8/1992 | Heffer | 124/8 |
| 5,335,953 | A * | 8/1994 | Luther, Sr. | 294/19.2 |
| 5,476,297 | A * | 12/1995 | Lombard | 294/19.2 |
| 6,199,926 | B1 * | 3/2001 | Lemoine | 294/19.2 |
| D449,864 | S * | 10/2001 | Forkert | D21/721 |
| 6,334,546 | B1 * | 1/2002 | Wang | 221/197 |
| 6,739,477 | B1 * | 5/2004 | Pascual | 221/199 |
| 7,992,747 | B2 * | 8/2011 | Bauer | 221/197 |
| 2004/0082411 | A1 * | 4/2004 | Fluckiger et al. | 473/446 |
| 2005/0115981 | A1 * | 6/2005 | Sands et al. | 221/150 R |
| 2005/0230984 | A1 * | 10/2005 | Seefeldt et al. | 294/19.2 |
| 2007/0111829 | A1 * | 5/2007 | Verga | 473/517 |
| 2008/0185855 | A1 * | 8/2008 | Compton | 294/19.2 |

* cited by examiner

*Primary Examiner* — Gene Kim
*Assistant Examiner* — John E Simms, Jr.

(57) ABSTRACT

A clay target magazine comprising a wall of cylindrical shape, said wall having at least one sight window provided therein, said magazine having slots provided in said wall proximate to said walls lower end to accept a retaining means therein, said magazine sized to hold a plurality of clay targets, said magazine further sized in order to be loaded into the carousel of a clay target trap.

9 Claims, 7 Drawing Sheets

CLAY TARGET MAGAZINE

FIELD OF THE INVENTION

The invention pertains to the field of clay targets used primarily for trap, skeet and sporting clay shooting. More particularly, the invention pertains to a magazine into which clay targets are loaded for insertion into the carousel of a clay target thrower.

REFERENCE TO RELATED APPLICATIONS

This application is an original first filing; no provisional, continuation or other document has been filed with the United States Patent & Trademark Office by applicant pertaining to this subject matter.

ACKNOWLEDGMENT OF GOVERNMENT SUPPORT

This invention was not developed with any type of government support. The government has no rights in applicant's invention.

BACKGROUND OF THE INVENTION

In the sporting world, several different types of competitive shooting involving shotguns have emerged over the years including, trap, skeet, sporting clays and a variation of skeet and sporting clays administered by the Federation Internationale de Tir Aux Sportives de Chasse, or the "FITSC."

In FITSC, strategically placed clay target throwers (called traps) set to simulate live game birds and animals; e.g., teal, rabbits, pheasant. Shooters on each layout or "parcour", shoot in turn at various combinations of single and double clay birds. Each station or "peg" on a parcour will have a menu card that lets the shooter know the sequence of clay birds he or she will be shooting at (i.e. which trap the clay bird will be coming from).

In order to establish the parcour, the traps or throwers must be positioned and adjusted to throw the sequence of targets generally in the following simulations: rabbit, chandelle, overhead, trap (outgoing), crossing, teal (launched straight up into the air), and as an incoming bird. The targets are shot as singles and as doubles (double targets can be simultaneous, on report or trailing/following-"rafael" in FITASC terminology).

Courses are laid out with as many as 13 stations, sometimes as many as 16 or more where shooters may shoot at as many as 8 targets each and generally will throw a set of targets in order to see how the peg is to be "played" or shot.

Therefore, it takes as many as 234 clay targets just for a pair of shooters to complete shooting a 13 station course. If 50 pairs of shooters were to compete in one day, 11,700 clay targets would have to be thrown by 26 throwers in the 13 stations. It should be noted that the typical course, regardless of number of stations, includes 100 shots by each shooter, plus any broken clays or target "peeks" involving throwing the birds to view how the station is to be played.

The throwers are typically remotely actuated by a controller provided at each station. Atop the throwers are carousels which contain stacks of clay targets (also referred to herein as clays) such that when the carousel is actuated, it rotates the stacks and a clay is positioned to drop onto a plate where a spring actuated throwing arm is pre-positioned to engage the clay and throw it with a certain amount of stabilizing spin.

Presently, these carousels are hand loaded with clays, necessitating the transport of boxes of clays to the throwers so that a person may open each box, grab a number of clays from within and stack them in columns in the carousel positioned atop the thrower. This is a labor intensive effort and because clays are fairly fragile, some breakage of clays during the process is inevitable.

What is needed is a way to load these carousels with clays in a manner which is not only faster, but results in less breakage.

It is not uncommon to have clays "jam" in the carousel when actuated or break from being cocked as a result of improper stacking during the filling of the carousel. Further, it is difficult to determine if a clay has been cracked during refill of the carousel by hand; the realization coming upon the throwing of the target when it is ejected from the thrower in pieces. Hairline fractures cannot be readily seen, especially within a stack of several clays. If during hand loading of the carousel, several clays are dropped into place incorrectly or are in a cocked position when dropped onto the stack, undetected damage may be done to one or more clays.

What is needed is a better method of loading a carousel by minimizing the handling of the clay targets.

Another factor which affects the integrity of clay targets is exposure to heat, cold and moisture. Admittedly, most shooting courses attempt to protect their traps from the elements. However, it is not practical to move the traps indoors from their setup position daily for protection. Sometimes enclosures are used for the throwers in the case of trap and skeet ranges as the need to continually move the throwers does not exist. For sporting clays, the setup of throwers is continually changed, making the use of enclosures more cumbersome.

In such cases, coverings such as canvass, tarps, plastic or other temporary means are employed to protect the carousels of clay targets. These coverings are certainly less effective than stationary enclosures, and the deterioration of clay targets on sporting clay ranges is more problematic. What is needed is a means of protecting carousels and their targets more effectively on sporting clay courses.

As mentioned, the number of shooters visiting a sporting clays range during a competition or group "shoot" means that many targets will be used and consequently, reloading of carousels will be necessary. By the sheer numbers of targets consumed in a shoot, inevitably shooters must standby while others spend valuable time hand loading carousels. In the case of a jammed thrower, this can lead to disruption of the competition. Operators of such courses must urge shooters to resist intervening on their own to clear jammed throwers when forced to wait until maintenance personnel or mechanics arrive to clear the machines. By intervening, shooters create a safety hazard to themselves and others as they are typically not trained how to operate and maintain the throwers, creating a potentially dangerous situation and likely a violation of the course insurance policies.

What is needed is a more efficient means of reloading carousels during competitive shoots when time pressure is at its highest, as well as assuring that the potential for weak or cracked clays in the carousels is minimized. Such a solution will assure timely use of the course and minimize potential safety hazards.

To quantify the problem further, clay target manufacturers estimate premature target breakage as high as 5%. Reducing human handling of targets can reduce that percentage significantly.

Typically, clay targets of 108 mm diameter are used for most throws. In international competition, clays to 110 mm may be used. In other cases, clays as small as 90 mm or smaller can be used as targets. With these varying sizes, carousels must be configured to handle either the 108-110 mm size, or be reconfigured to handle 90 mm targets such that the targets are properly positioned to drop onto the throwing plate properly. As a result, courses must have carousels of more than one configuration in order to accommodate the various clay target sizes. What is needed is a solution to having to use differently configured carousels to throw clay targets of differing size. Expense and labor would each be saved by having a method or device which facilitates the throwing of multiple sizes of clays without having to reconfigure a carousel or replace it entirely with another trap so configured.

SUMMARY OF THE INVENTION

Applicant has devised a magazine to hold clay targets in such a configuration to allow direct insertion into a carousel thereby minimizing the amount of human handling. In doing so, the time required to load carousels is also reduced significantly.

The magazine which is the object of Applicant's invention is a substantially cylindrical container which holds the clays in a stack thereby reducing the amount of jostling and rattling during transport to a carousel as well as during loading. The act of inserting a single stack into the empty column of a carousel takes only a few moments compared to the insertion of a smaller number of clays into the carousel column and then repeating the procedure several times until the column is full. Further, the vulnerability to improper stacking, dropping the clays onto each other or otherwise cracking them is reduced by using Applicant's magazine.

Most if not all of the components of Applicant's invention may be fashioned from a variety of materials including wood, plastic, resin or metal. In the preferred embodiment, polyethylene, polyvinylchloride or other Ultra Violet light ("UV") & water resistant, tough plastic is preferred.

Applicant's magazine may be loaded with clays by simply drawing the magazine down over stacked clays while in their shipping box in a simple, cookie-cutter manner, virtually eliminating the need for handling them. This aids in eliminating unnecessary handling and the potential for damage to the clays.

In one embodiment, the magazine is slidably inserted into a loading sleeve which has means to capture the clays in the magazine as clays are inserted. The loading sleeve captures the bottom clay in each stack, retaining it while both sleeve and magazine are lifted and placed above another stack of clays for insertion into the magazine. This is repeated until the magazine is filled. The loading sleeve is provided with a retention means such that when the effective bottom of a stack is reached, the retention means holds the bottom of the stack of clays so that both the magazine and the sleeve may be lifted for additional filling of clays or if already full, for insertion of a retention means in the actual magazine. When the retention means is inserted in the full magazine, the loading sleeve may then be slid off the magazine and another, empty magazine may be inserted into the loading sleeve and the process repeated until the desired number of magazines are filled.

A number of retention means may be used for the loading sleeve; e.g., a spring loaded "detent" having a level top surface and an angled lower surface can slide over clays as they fill the loading sleeve and hence the magazine, but when lifted, the level upper surface engages the bottom of a clay, thereby fixing it in a relative position within the sleeve and magazine, allowing the combination to be lifted and then set atop another plurality of clays to continue the filling process. While the shape of the detent described has a particular application in this regard, trying to provide a lifting surface in contact with the bottom surface of the last clay inserted, other configurations of detent; e.g., a ball detent or others, may also be utilized if the amount of force applied to the rim of the bottom clay in a horizontal direction is minimized. The larger the stack of clays, including the heavier, or larger diameter size will determine the effectiveness of other retention means.

In one embodiment of Applicant's invention, holes or slots are provided in the magazine wall for the purpose of allowing the points of the detents provided in the loading sleeve to project therethrough, allowing indexing of the loading sleeve to the magazine. Such indexing of said magazine and said sleeve further assists loading said magazine, further facilitating retaining the clay target stack in the magazine above the retaining means slot which may be then easily accessed. In this embodiment, when said retaining means is inserted into said magazine, the loading sleeve may be slid downward over the magazine slightly depressing and disengaging the detents from said magazine, and then rotated such that the loading sleeve may be lifted off the magazine with detents depressed, as said retaining means may interfere the removal of said sleeve by sliding it downward and off said magazine.

Another retention means may be a simple spring clip having a predetermined curvature or other shape allowing the clays to move the clip to the side, allowing the clay to slid up into the sleeve and magazine, but when the clay passes the clip, the clip springs back to a position which will retain the clay in addition to any of those atop it. A variation of this retention means is a clip which is proximate to the bottom of said sleeve and is actuated either manually or by a concentric sliding ring, after filling, in order to engage the lower surface of the bottom clay. Another spring clip so used may be slidably mounted on the side of the sleeve such that when slid over a slot in said sleeve, said clip engages the lower surface of the bottom clay.

The preferred embodiment of Applicant's magazine includes at least one window or sight slot which enables one to see how full the magazine is, both to aid the filling of the magazine, and also to indicate when the number of clays in the magazine is depleted, thereby signaling when the magazine should be refilled, "reloaded" or "recharged."

Another feature of the preferred embodiment of Applicant's invention is the type of retention means used to keep the stack of clays inside the magazine after the loading sleeve is removed (assuming a loading sleeve is used). Because of the fragile nature of the clay targets, the amount of force applied to the bottom clay must be considered in the decision how best to secure the stack inside the magazine. For example, if a round pin were extended through the magazine walls underneath the bottom clay, two load bearing points would bear effectively the entire weight of the stack of clays, the vertical component of frictional force of the stack against the interior of the magazine being negligible. The two point contacts would see stress risers which could give rise to crack propagation in said bottom clay. To alleviate this problem, Applicant utilizes a U-shaped, flat retaining means distributing the stack weight along four flat surfaces (effectively), minimizing the aforementioned problem.

Consequently, proximate to the bottom of the magazine are provided four slots in which said retaining means is slid, thereby bearing the stack load within said magazine. In this embodiment, the bottom edge of the associated loading sleeve is relieved to provide access to the magazines retention means slots. In this embodiment, if a loading sleeve is used which employs the angled spring loaded detent, the sleeve is then slid slightly to depress the detent, then rotated sufficient to slide said loading sleeve up and off said magazine, thereby eliminating any resistance from said magazine's retaining means which may prohibit sliding the loading sleeve of the magazine in a downward direction.

In the case where a smaller diameter magazine is loaded with smaller clays, Applicant provides a spacer which can be slidably mounted at the top and or bottom of the carousel such that the clays are aligned with the lower part of the carousel and may be dropped to the lower plate in proper alignment with the throwing lever.

The spacer described above may be of multiple configurations including fully round, having "dog ears" spaced to engage the carousel column risers typically used to house the stack of clay targets, or even provided with cutouts to slidably engage said risers, thereby further assisting in the alignment of said magazine in said carousel.

In another embodiment of the present invention, the magazine which is sized to hold the 108 mm and larger clays, may have inserted therein a smaller magazine which is similarly loaded, said outside diameter of said smaller magazine aligned in said larger magazine by spacers proximately located at both ends of said smaller magazine and in communication with the inner diameter of said larger magazine. This too allows smaller magazines to be used in carousels configured to accept the larger diameter magazines, all the while keeping alignment proper to drop any sized clay onto said throwing plate.

By utilizing spacers, Applicant provides the means whereby smaller diameter clays may be thrown from carousels configured to hold that largest diameter clays, obviating the need to reconfigure the carousels or move other traps in place to throw said smaller clays. This feature of Applicant's invention provides savings in terms of time, money and labor in significant amounts. Applicant believes that this capability to utilize pre-loaded magazines of clay targets having differing diameters in a single carousel provides an innovative solution to enabling a single carousel to throw different diameter clay targets, but also enables a course to offer additional target combinations from that same station heretofore not possible from the same trap.

In another embodiment of Applicant's invention, a smaller sized magazine is inserted directly into the carousel of a trap, said magazine employing spacers to locate said magazine within the column risers of said carousel. The spacers may be integral to, removably applied or affixed to said magazine, in some cases said lower spacer may be provided with cut-outs to allow for handling access for loading and inserting said retaining means as well as placing said magazine inside said carousel.

In the preferred embodiment of Applicant's invention, a cap or lid is provided for placement atop the magazine when inserted into the carousel. By applying a lid, the amount of moisture to which the clays may be exposed to when left overnight in the carousel is dramatically reduced if the course is exposed to precipitation. In one embodiment, the cap may be rotatably and removably affixed to said magazine, and further, may be provided with a handle in order to lift and handle said magazine. In other embodiments, said handle may be integral to the magazine itself, absent any cap or lid.

While the loading sleeve facilitates the quick loading of the magazine all but eliminating contact between the clays and human hands, instances may occur where it is necessary to load the magazine by hand. This can also be accomplished with the same basic procedure, with reliefs in the bottom edge of the magazine sized to allow the insertion of fingers on either side to retain the clays therein while the magazine is lifted and placed atop another stack to be inserted into the magazine. In the end it will be necessary to lift the bottom clay sufficiently to allow insertion of the retaining means. In one embodiment of the present invention, Applicant utilizes a loading block which would facilitate the retention means insertion by placing the magazine over said block, said block provided with two raised areas upon which the bottom clay is engaged, thereby lifting said clay, enabling said retaining means to be inserted into said magazine.

In most of Applicant's embodiments, it should be noted that the inner diameter of all magazines are sized to allow the free sliding of clay targets inside said magazines while restricting cocking of any individual target or the stack. For a 108 mm clay target, the inner diameter of the associated magazine my be between approximately 109 mm and 110 mm. Similarly, a magazine inner diameter of between approximately 91 mm and 92 mm may accommodate a 90 mm clay target. Sleeves further allow the similar free sliding of associated magazines therein and are therefore appropriately sized. Similarly, magazines including embodiments using spacers are located within existing carousel column guides such that adequate space exists to removably insert the magazines therein, with the wall thickness of said magazines sized to accept the proper sized clay target for that carousel.

DETAILED DESCRIPTION OF THE INVENTION

Figure 1:
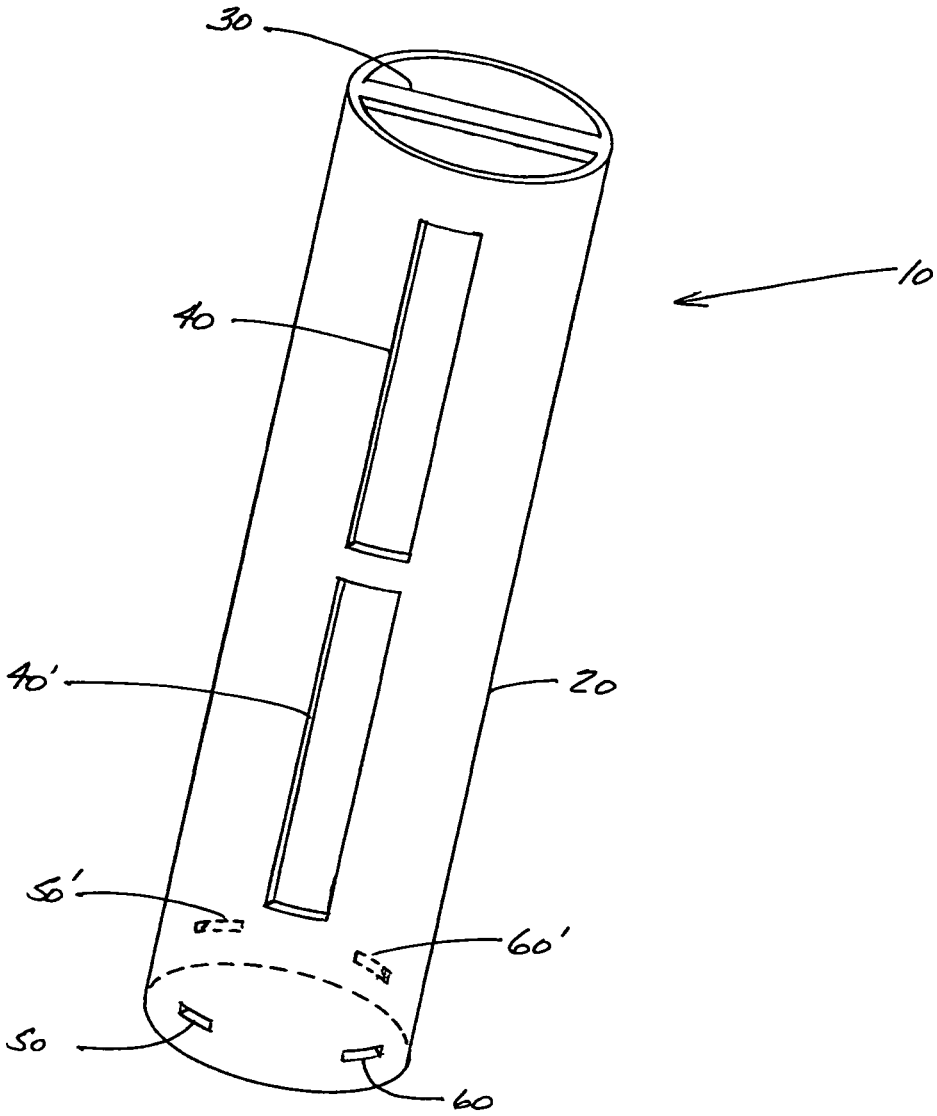
FIG. 1 is an isometric view of the magazine of Applicant's invention.

FIG. 1 shows an embodiment of Applicant's clay target magazine 10, comprising essentially a cylindrical magazine of predetermined thickness 20 having an upper end and an open lower end. A handle 30 extends across the sidewalls of said magazine 20. Two sight windows, 40 and 40' are provided in the wall of said magazine. Two slots 50 and 60 are located in the magazine 20 proximate to said lower end, with corresponding slots 50' and 60' located in said magazine wall substantially opposite said slots 50 and 60.

Figure 1A:
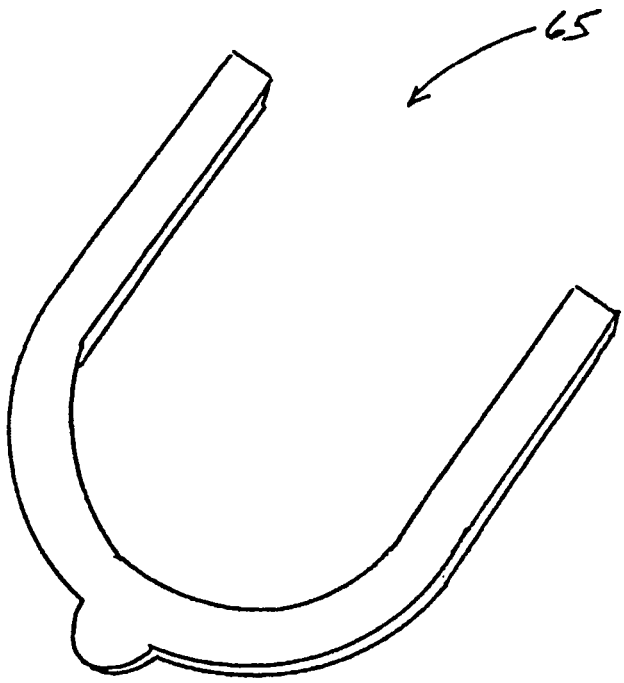
FIG. 1*a* is an isometric view of the retaining means of the invention of FIG. 1.

FIG. 1*a* discloses retention means 65 pertaining to the invention as shown in FIG. 1.

Figure 2:
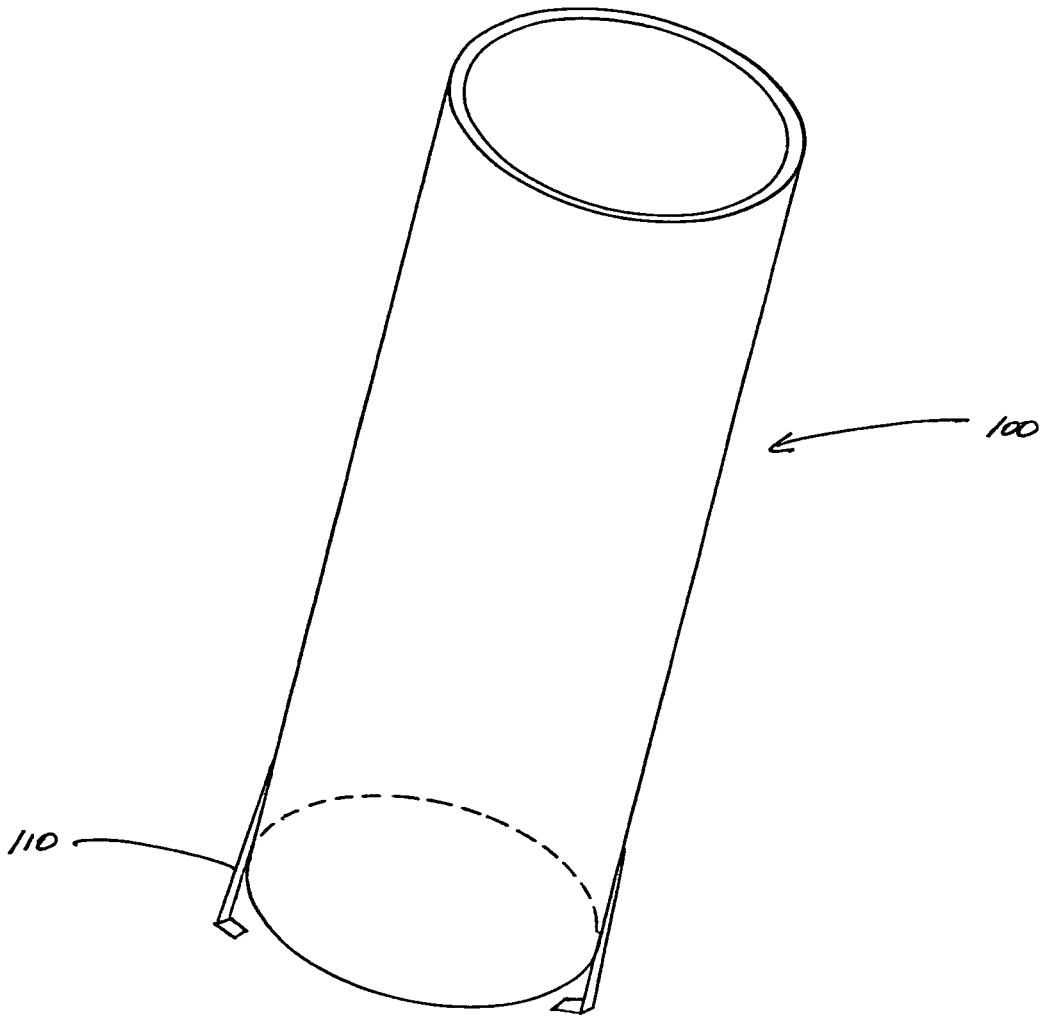
FIG. 2 is an isometric view of one embodiment of a loading sleeve.

FIG. 2 shows a loading sleeve 100, said sleeve sized to slidably accept magazine 10 therein, said sleeve's lower end having affixed thereto at least one spring clip 110, the distal end of said clip extending just beyond the end of said sleeve. Said clip may be of a variety of shapes to permit said clip to be moved away from said magazine to allow targets to be loaded or inserted, yet when released back to rest, contact the bottom surface of said targets thereby retaining them inside said magazine.

A variety of means for affixing said clips to either a magazine or a loading sleeve may be employed such as riveting, adhesive, threaded recess, clipping and more. Where a rivet is to be employed, the wall of said loading sleeve or said magazine may be recessed on the inner diameter such that said rivet may be captured therein. Similarly, a flanged, threaded barrel may be fitted in said recess to accept a threaded fastener, said fastener first penetrating said clip thereby affixing said clip when said fastener is screwed into said barrel. Said clips could further be retained on a ring removably or permanently affixed to said outer diameter of said magazine or sleeve, said ring held in a recess on the outer diameter of said magazine or sleeve, or adhered thereto by multiple means.

Figure 3:
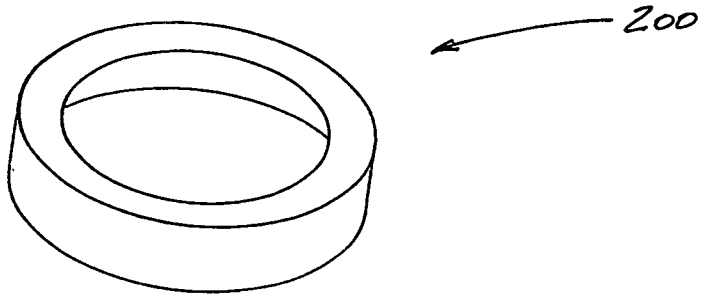
FIG. 3 is an isometric view of a magazine spacer.

FIG. 3 shows one embodiment of a magazine spacer 200, said spacer sized to be slidably and removably engaged on the perimeter of said magazine 20.

Figure 4:
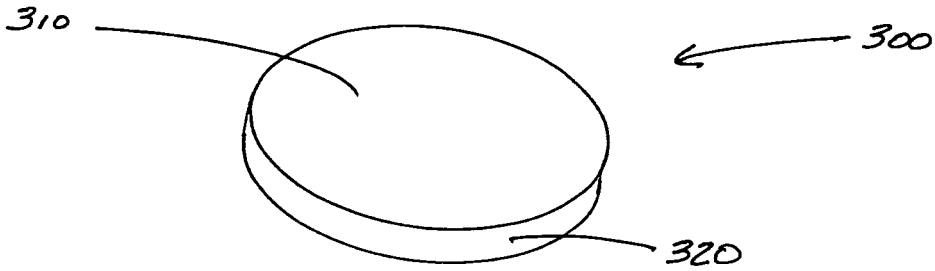
FIG. 4 is an isometric view of one embodiment of a magazine lid or cap.

FIG. 4 shows one embodiment of a cap or lid, 300, said lid or cap comprising a circular cap 310 with a sidewall 320 extending downward therefrom, said sidewall sized to be removably affixed to the upper end of magazine 20.

Figure 5:
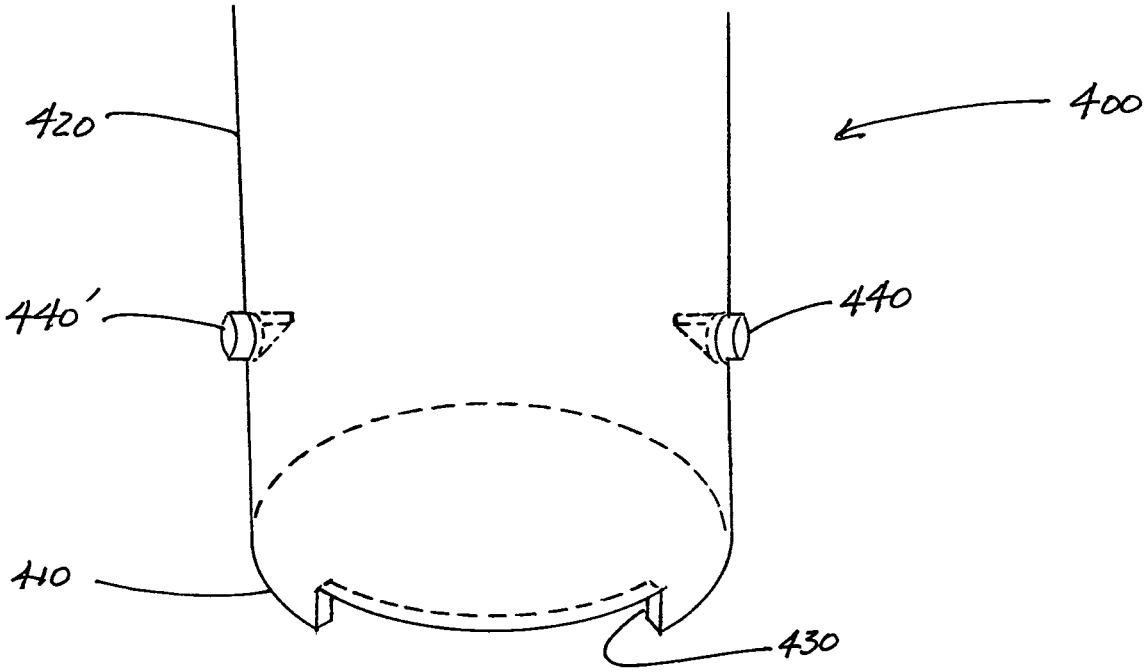
FIG. 5 is an isometric view of a second embodiment of a loading sleeve of Applicant's invention.

FIG. 5 is a partial view of an embodiment of loading sleeve 400, said sleeve having a bottom edge 410 of wall 420, said edge having a relief 430 provided along said edge 410. Said wall 420 also having a pair of spring-loaded detents, 440 and 440' extending therethrough, said detents 440 and 440' having an upper engaging surface normal to the inside of wall 420, and a lower engaging surface at an acute angle relative to said wall 420. In one embodiment of said magazine (not shown), corresponding slots are provided in the wall of said magazine through which said detents project thereby indexing said magazine to said sleeve, facilitating the loading and allowing both said magazine and said sleeve to be lifted together.

Figure 6:
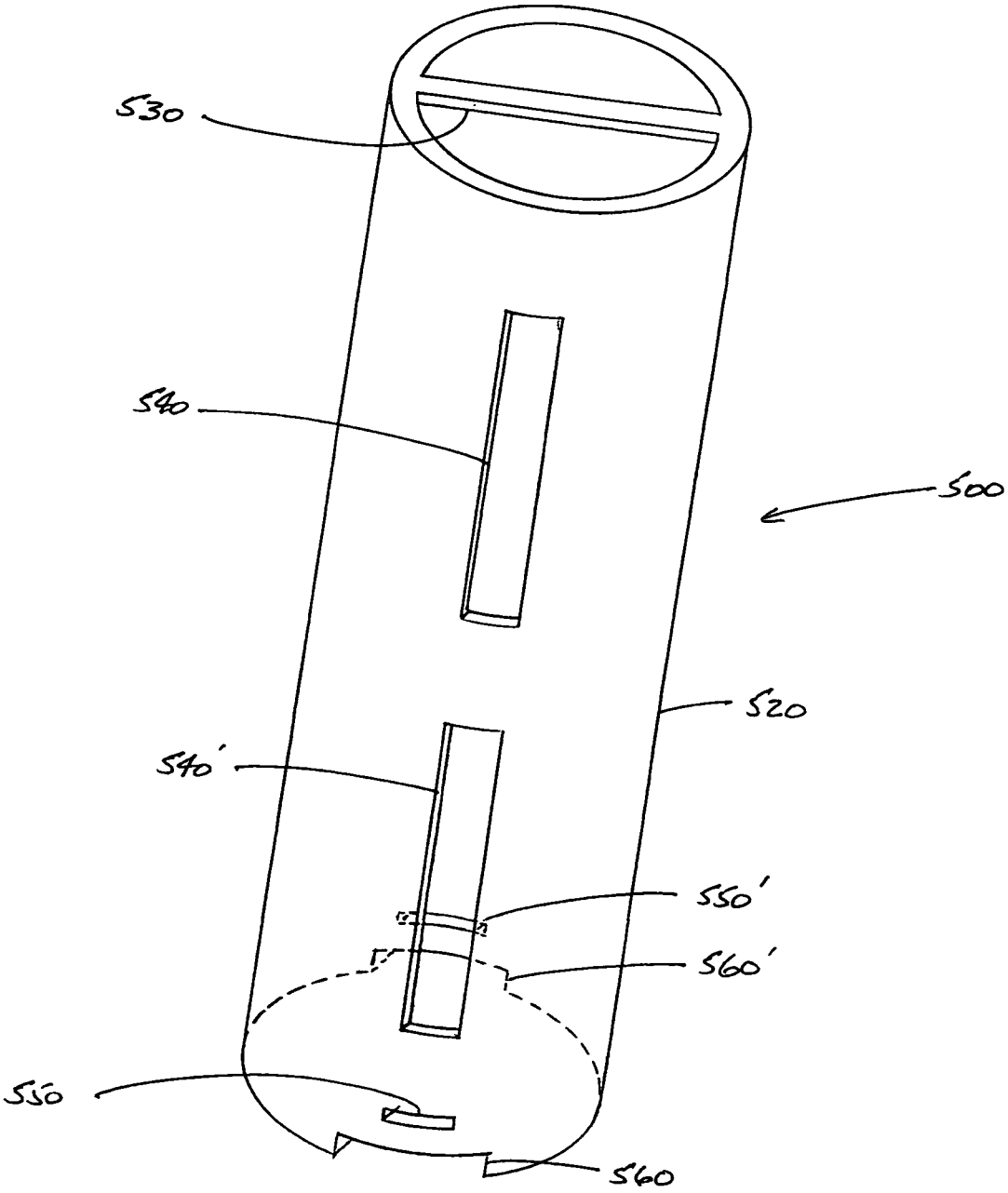
FIG. 6 is an isometric view of yet another embodiment of Applicant's clay target magazine.

FIG. 6 is a view of an embodiment of Applicant's clay target magazine 500, said magazine similar in configuration to the magazine of FIG. 1, said magazine 500 likewise comprising a cylindrical wall 520, a handle 530 at its upper end, sight windows 540 and 540' in said wall 520, opposing slots 550 and 550' proximate to the open lower end of wall 520, said open lower end of wall 520 having two reliefs 560 and 560' along the bottom edge of said wall.

Figure 7:
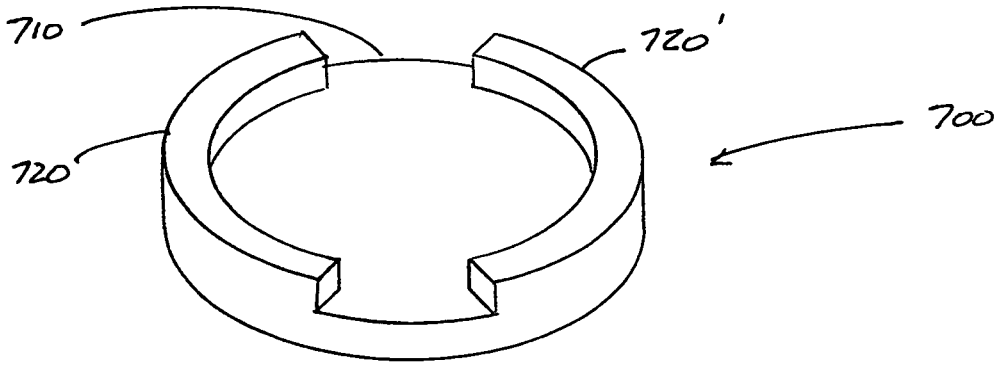
FIG. 7 is an isometric view of a loading block.

FIG. 7 shows one embodiment of loading block 700 comprising a circular base 710 whose diameter is sized to comfortably fit in the inside diameter of Applicant's magazine, said base having two raised arcuate edges 720 and 720' along said base's perimeter.

Figure 8:
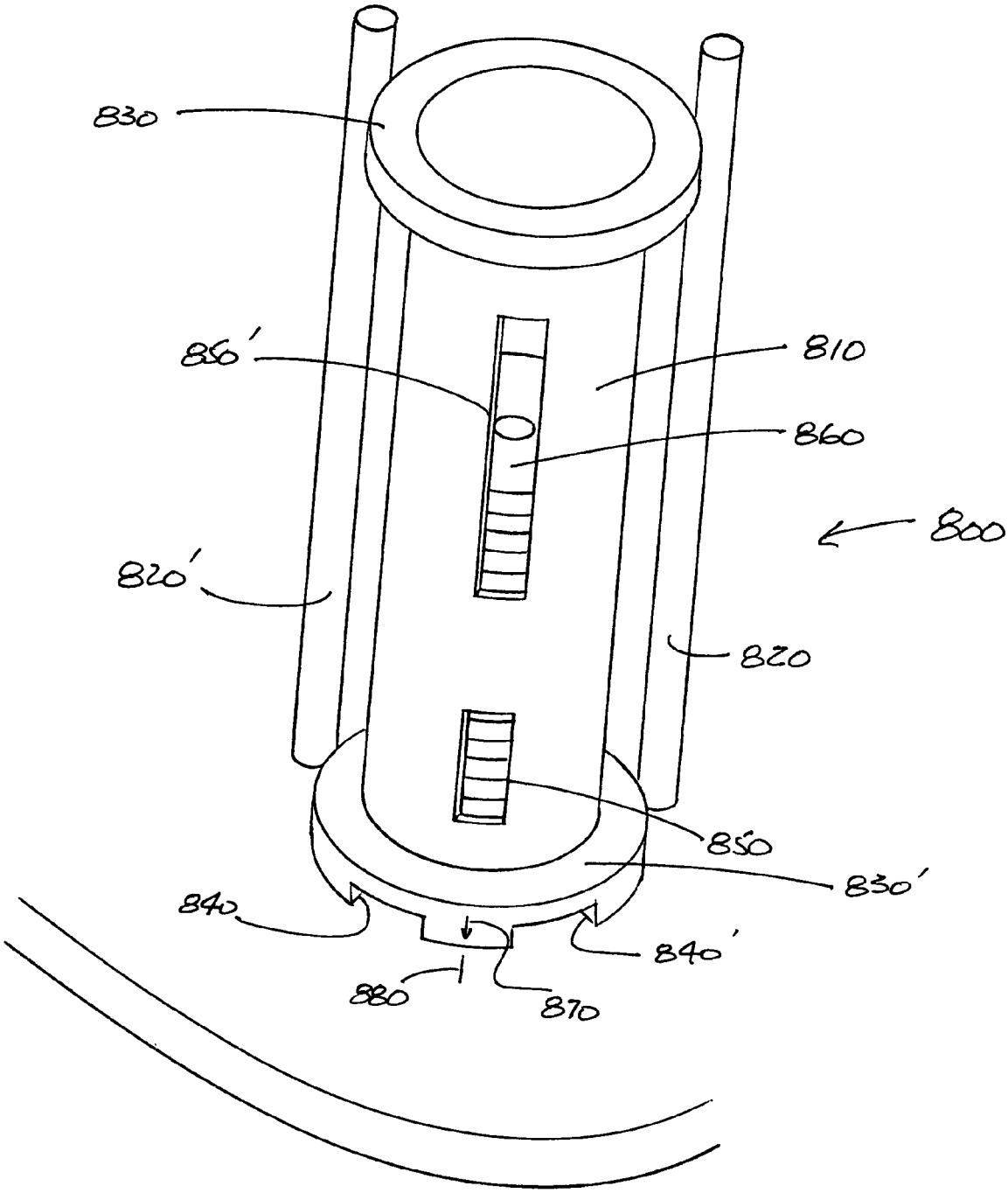
FIG. 8 is an isometric view of an embodiment of Applicant's invention for use with smaller diameter clay targets.

In FIG. 8, yet another embodiment of Applicant's invention comprises magazine 800, having a cylindrical wall 810 sized to slidably accept smaller diameter clay targets such as 90 mm diameter targets, is located within inner column guides 820 and 820' to rest on carousel plate 825 by two spacers 830 and 830'. Said magazine is similarly proximately located next to two outer column guides projecting from said carousel plate, said outer guides not shown in this figure. Said spacers may be integral to said magazine, permanently or removably affixed to the outside of wall 810 proximate to the upper and lower ends of said magazine.

Bottom spacer 830' may have a lower perimeter provided with one or more raised arcuate edges 840 and 840' to allow finger insertion for loading and handling. Sight windows 850 and 850' are located in wall 810 to provide an indication of how many clay targets, 860 remain in said magazine. In said embodiment, said window 850 is sized to reveal a smaller number of targets, up to perhaps 10, while said window 850' is sized to reveal a larger number of said targets. To assist in locating said magazine 800 atop said plate 825, an indicating mark 870 may be included on spacer 830' in order to be indexed to a second indicating mark 880 provided on plate 825.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A Clay Target Magazine comprising:

A cylindrical wall having an upper end and an open lower end, at least one slot proximate to said lower end, said slot projecting through said wall;

A sleeve sized to receive said wall and having at least one detent projecting inwardly, said detent also biased inwardly;

said sleeve being movable with respect to said wall in a first position where said detent is in registry with said slot and a second position wherein said detent is out of registry with said slot;

said detent being shaped to allow clay targets to be inserted into said wall when said sleeve is in said first position and said wall is pressed over and along a stack of clay targets, said targets pressing said detent outwardly sufficient to allow said targets to enter said sleeve and be retained by said inwardly biased detent whereby said magazine may be positioned on a trap machine carousel, said sleeve movable to said second position forcing said detent outwardly against said bias and said magazine may be lifted to deposit said stack of clay targets onto said carousel.

2. Invention of claim 1 further comprising:

said wall containing at least one window beginning a predetermined distance from said upper end of said wall and proceeding toward said lower end of said wall.

3. The invention of claim 1 further comprising:

a plurality of said slots being substantially opposed from one another in said wall, and retaining means configured to be inserted into more than one of said slots.

4. The invention of claim 1 further comprising:

said lower end of said wall having at least one relief along said wall's bottom edge.

5. The invention of claim 1 further comprising:

a loading block, said loading block sized to fit inside said wall's lower end, said block having at least one raised edge thereby establishing a raised portion and an unraised portion of said block such that when positioned inside said wall's lower end, said unraised portion being substantially proximate to said wall's bottom edge.

6. The invention of claim 1 wherein:

said upper surface of said inwardly projecting detent being substantially normal to said sleeve, said lower surface of said detent defining an acute angle with said sleeve.

7. The invention of claim 1 wherein:

said upper surface of said inwardly projecting detent being substantially normal to said sleeve, said lower surface of said detent being substantially spherical.

8. The invention of claim 3 further comprising:

said means being U-shaped.

9. The invention of claim 1 further comprising:

at least one spacer having an inner diameter sized to slidably engage said magazine wall and an outer diameter sized to retain said magazine inside the upward projecting column risers of the carousel of a clay target throwing trap such that when said magazine is loaded with clay targets, said targets are properly aligned in said carousel to be thrown when said trap is actuated.

* * * * *